US006302455B1

(12) United States Patent
Huang

(10) Patent No.: US 6,302,455 B1
(45) Date of Patent: Oct. 16, 2001

(54) ELECTRIC SAFEGUARD DOOR LOCK

(76) Inventor: Chao-Lin Huang, No. 4-12, Tien-Chung Rd., Shi-Hu Chen, Changhwa Hsien (TW)

( * ) Notice: Subject to any disclaimer, the term of this patent is extended or adjusted under 35 U.S.C. 154(b) by 0 days.

(21) Appl. No.: 09/406,148

(22) Filed: Sep. 27, 1999

(51) Int. Cl.[7] ..... E05C 3/06; E05B 51/00
(52) U.S. Cl. ..... 292/199; 292/201; 70/275
(58) Field of Search ..... 292/201, 199, 292/341.16, 304, 210; 70/275

(56) References Cited

U.S. PATENT DOCUMENTS 4,881,766 * 11/1989 Schmidt et al. ..... 292/201
4,929,003 * 5/1990 McConnell ..... 292/144
5,148,691 * 9/1992 Walldén ..... 70/279
5,437,173 * 8/1995 Spinar ..... 70/89
5,452,927 * 9/1995 Uyeda ..... 292/202
5,474,340 * 12/1995 Brackmann et al. ..... 292/216
5,566,991 * 10/1996 Young ..... 292/201
5,722,272 * 3/1998 Bridgeman et al. ..... 70/264
5,825,288 * 10/1998 Wojdan ..... 340/542
6,089,058 * 7/2000 Elpern et al. ..... 70/279.1
6,109,667 * 8/2000 Collins ..... 292/78
6,112,563 * 9/2000 Ramos ..... 70/278.1

* cited by examiner

*Primary Examiner*—Anthony Knight
*Assistant Examiner*—Matthew E. Rodgers
(74) *Attorney, Agent, or Firm*—Dellet and Walters

(57) ABSTRACT

An electric safeguard door lock includes a lock base having an elongated plate containing an opening, two side plates each attached to the elongated plate and each containing an arcuate slot, a lock bolt pivotally mounted on a first pivot axle and having a first end detachably extending through the opening and a second end containing a slide slot, a push rod slidably received in the slide slot and having two ends each slidably received in the arcuate slot, at least one pawl member pivotally mounted on a second pivot axle and having a first end formed with a first arm containing a notch detachably receiving the push rod, and a second end formed with a second arm containing an abutting recess, a wheel including a worm gear mounted thereon, an actuating member secured on the wheel to rotate therewith and including two drive stubs each detachably abutting the abutting recess, a speed reduction motor mounted in the assembly space, and a worm mounted on the speed reduction motor and meshing with the worm gear.

7 Claims, 4 Drawing Sheets

ELECTRIC SAFEGUARD DOOR LOCK

BACKGROUND OF THE INVENTION

1. Field of the Invention

The present invention relates to an electric safeguard door lock.

2. Description of the Related Art

A conventional electric lock adapted to be fit onto a door is used to unlock the door by pressing push buttons mounted on a panel connected to the electric lock, thereby allowing a user to open the lock without having to carry the lock keys at all times. However, the conventional electric lock has a complicated structure, thereby limiting the utility thereof. The present invention has arisen to mitigate and/or obviate the disadvantage of the conventional electric lock.

BRIEF SUMMARY OF THE INVENTION

In accordance with the present invention, an electric safeguard door lock includes a lock base having an elongated plate containing an elongated opening, two parallel side plates each attached to the elongated plate and each containing an arcuate slot, and an assembly space defined between the two side plates, a first pivot axle secured in the assembly space, a lock bolt pivotally mounted on the first pivot axle and having a first end detachably extending through the opening and a second end containing a slide slot, a push rod slidably received in the slide slot and having two ends each slidably received in the arcuate slot of a corresponding one of the two side plates, a second pivot axle secured in the assembly space, at least one pawl member pivotally mounted on the second pivot axle and having a first end formed with a first arm containing a notch detachably receiving the push rod, and a second end formed with a second arm containing an abutting recess having a periphery, a wheel rotatably received in the assembly space and including a worm gear mounted thereon, an actuating member secured on the wheel to rotate therewith and including two opposite drive stubs each detachably abutting the periphery of the abutting recess of the second arm of the pawl member, a speed reduction motor mounted in the assembly space, and a worm mounted on the speed reduction motor and meshing with the worm gear.

Further benefits and advantages of the present invention will become apparent after a careful reading of the detailed description with appropriate reference to the accompanying drawings.

DETAILED DESCRIPTION OF THE INVENTION

Figure 1:
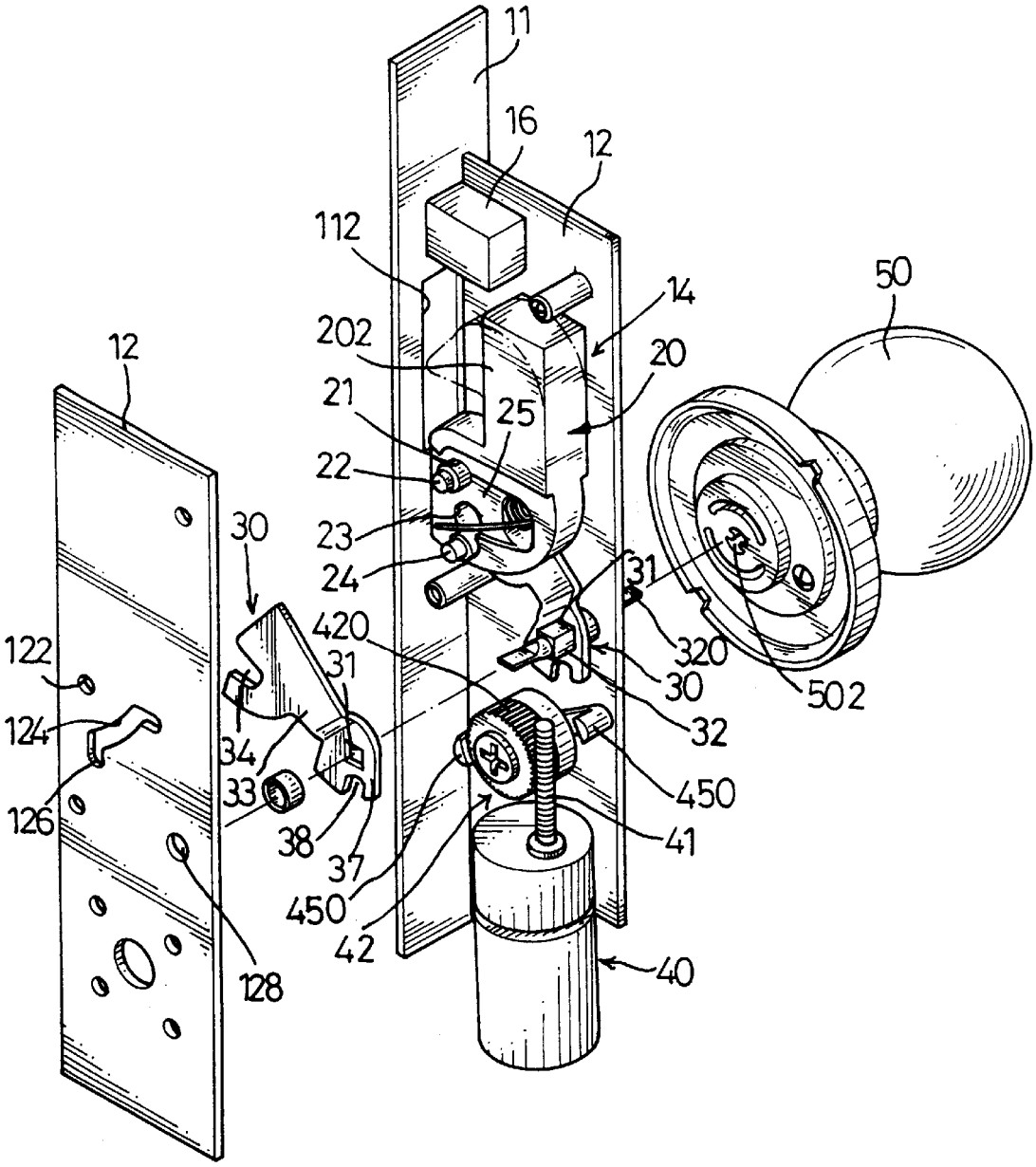
FIG. 1 is an exploded perspective view of an electric safeguard door lock in accordance with the present invention.
Figure 2:
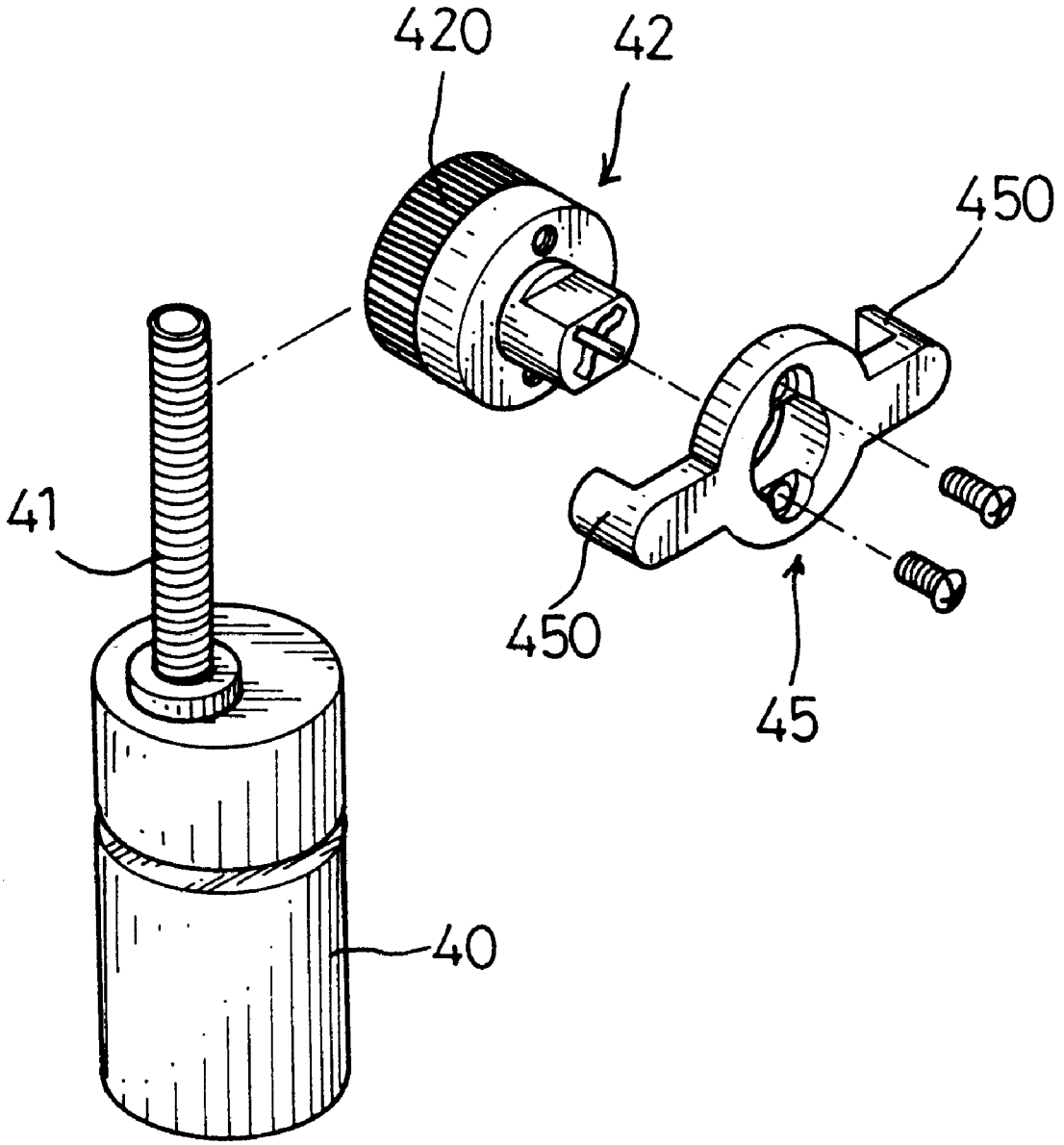
FIG. 2 is an exploded view showing a wheel, an actuating member, a worm and a speed reduction motor.
Figure 3:
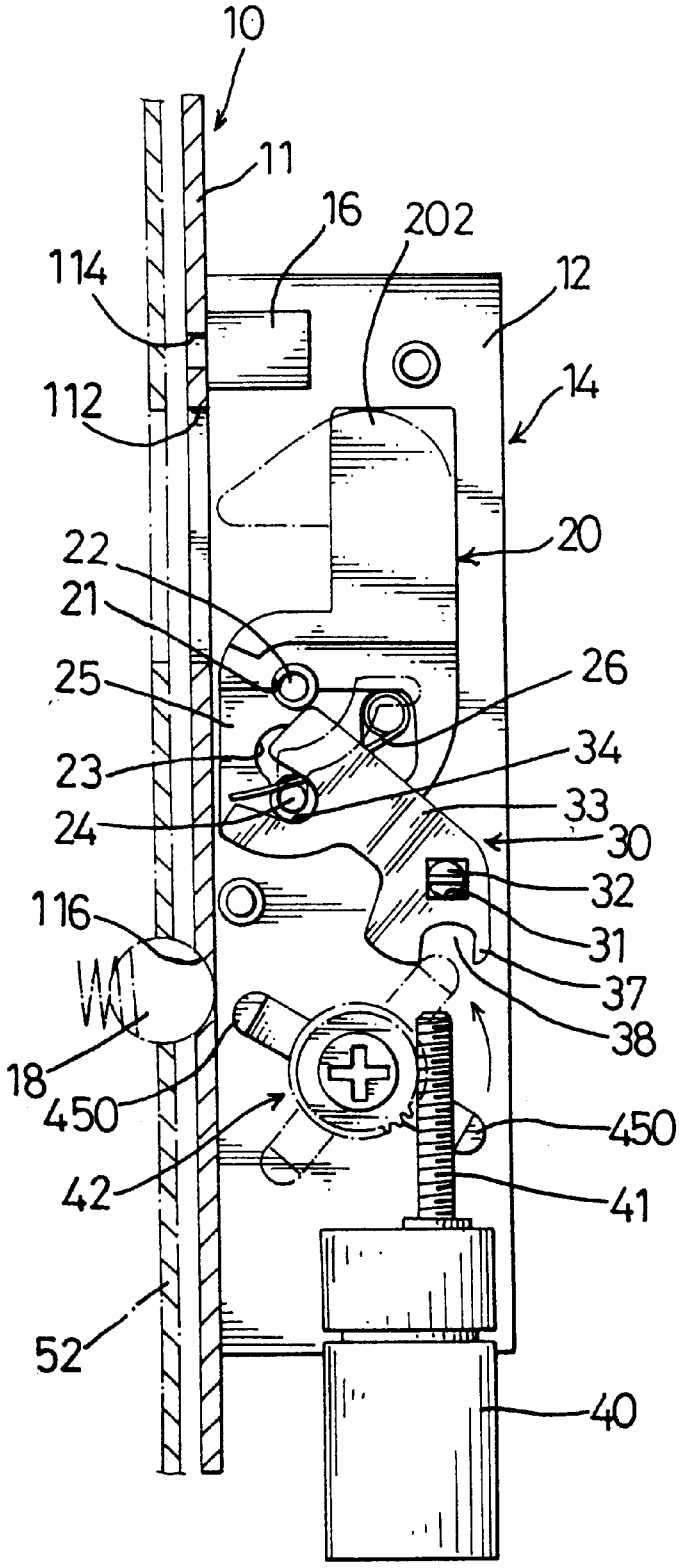
FIG. 3 is a side plan cross-sectional view of the electric safeguard door lock as shown in FIG. 1.

Referring to the drawings and initially to FIGS. 1–3, an electric safeguard door lock in accordance with the present invention comprises a lock base (10) including an elongated plate (11) containing an elongated opening (112), two parallel side plates (12) each attached to the elongated plate (11) and each containing an arcuate slot (124), and an assembly space (14) defined between the two side plates (12), a first pivot axle (22) secured in the assembly space (14), a lock bolt (20) pivotally mounted on the first pivot axle (22) and having a first end (202) detachably extending through the opening (112) and a second end containing a slide slot (23), a push rod (24) slidably received in the slide slot (23) and having two ends each slidably received in the arcuate slot (124) of a corresponding one of the two side plates (12), a second pivot axle (32) secured in the assembly space (14), two pawl members (30) each pivotally mounted on the second pivot axle (32) and each having a first end formed with a first arm (33) containing a notch (34) detachably receiving the push rod (24), and a second end formed with a second arm (37) containing an abutting recess (38), a wheel (42) rotatably received in the assembly space (14) and including a worm gear (420) mounted thereon, an actuating member (45) secured on the wheel (42) to rotate therewith and including two opposite drive stubs (450) each detachably abutting the periphery of the abutting recess (38) of the second arm (37) of the pawl member (30), a speed reduction motor (40) mounted in the assembly space (14), and a worm (41) mounted on the speed reduction motor (40) and meshing with the worm gear (420).

The elongated plate (11) contains a hole (114), and the electric door lock comprises a sensor (16) mounted in the hole (114) to detect if the door (52) is closed or opened. The elongated plate (11) also contains a concave surface (116), and the electric door lock comprises a positioning ball (18) abutting the concave surface (116) whereby the door (52) is retained in a correct position by means of the positioning ball (18) received in the concave surface (116).

Each of the two side plates (12) contains a locking hole (122), and the first pivot axle (22) extends through a pivot hole (21) defined in the lock bolt (20) and has two ends each secured in the locking hole (122) of a corresponding one of the two side plates (12). The arcuate slot (124) of each of the two side plates (12) has two distal ends each containing a retaining recess (126).

The lock bolt (20) contains a recessed surface (25) formed on the second end thereof, and the electric door lock further comprises a torsion spring (26) received in the recessed surface (25) and abutting the push rod (24).

Each of the two side plates (12) contains a through hole (128), and the second pivot axle (32) extends through a pivot hole (31) defined in each of the two pawl members (30) and has two ends (320) each extending through the through hole (128) of a corresponding one of the two side plates (12). The second pivot axle (32) has its one end (320) secured in a locking hole (502) of a knob (50) such that the second pivot axle (32) can be directly rotated by the knob (50).

Figure 4:
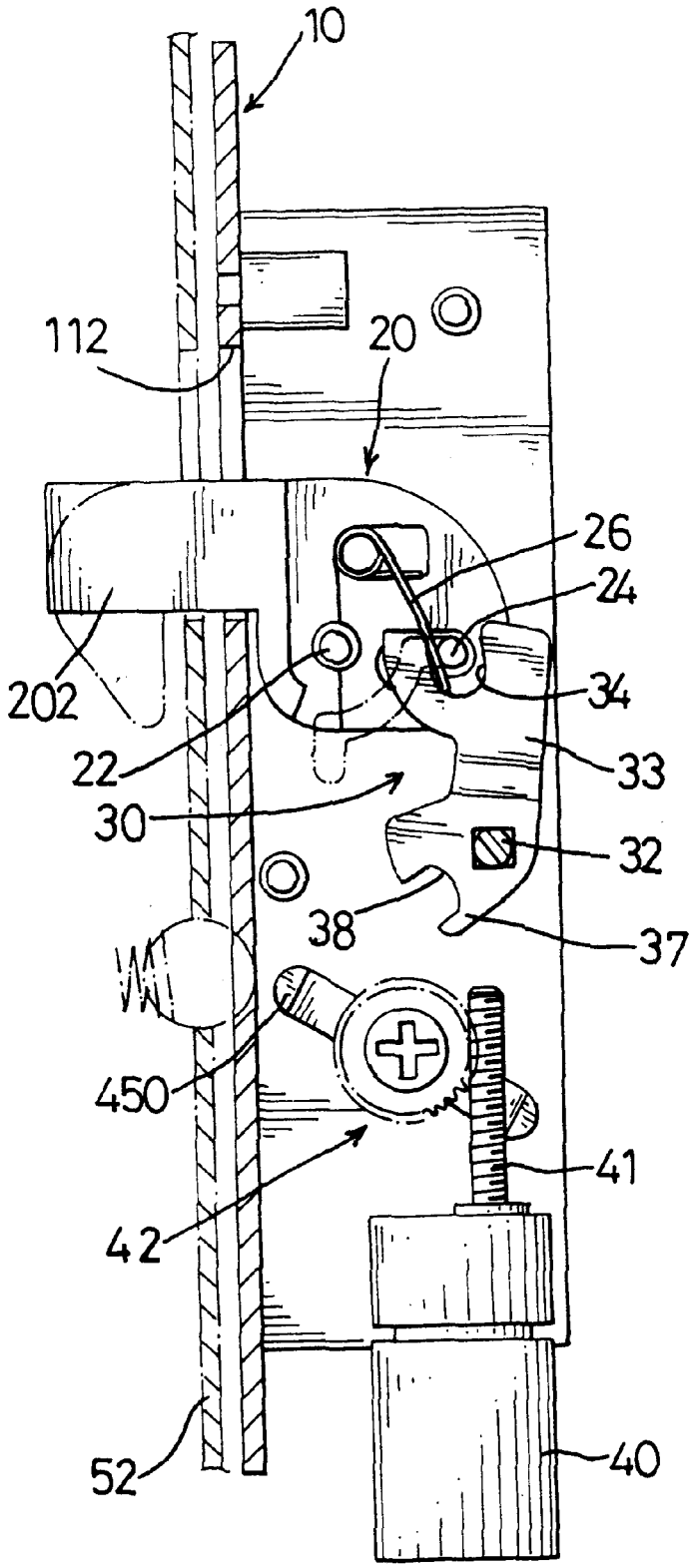
FIG. 4 is an operational view of the electric safeguard door lock as shown in FIG. 3.

In operation, referring to FIGS. 3 and 4 with reference to FIGS. 1 and 2, the worm (41) is rotated by the speed reduction motor (40) to rotate the worm gear (420) which rotates the wheel (42) which rotates the actuating member (45) so that one of the two drive stubs (450) is moved by the actuating member (45) to abut the periphery of the abutting recess (38) so as to move the second arm (37) of each of the two pawl members (30), thereby pivoting each of the two pawl members (30) about the second pivot axle (32) from the position as shown in FIG. 3 to the position as shown in FIG. 4, whereby the push rod (24) is moved by the notch (34) of the first arm (33) of each of the two pawl members (30) so as to move the second end of the lock bolt (20) upward, thereby pivoting the lock bolt (20) about the first pivot axle (22) from the position as shown in FIG. 3 to the position as shown in FIG. 4, such that the first end (202) of the lock bolt (20) is inserted into the opening (112), thereby securing the elongated plate (11) to a door (52) by the first end (202) of the lock bolt (20).

The second pivot axle (32) can be directly rotated by the knob (50), thereby pivoting the pawl members (30) so as to manually lock/unlock the door (52) by the first end (202) of the lock bolt (20).

It should be clear to those skilled in the art that further embodiments may be made without departing from the scope of the present invention.

What is claimed is:

1. An electric safeguard door lock comprising:

a lock base (10) including an elongated plate (11) containing an elongated opening (112), two parallel side plates (12) each attached to said elongated plate (11) and each containing an arcuate slot (124), and an assembly space (14) defined between said two side plates (12);

a first pivot axle (22) secured in said assembly space (14);

a lock bolt (20) pivotally mounted on said first pivot axle (22) and having a first end (202) detachably extending through said opening (112) and a second end containing a slide slot (23);

a push rod (24) slidably received in said slide slot (23) and having two ends each slidably received in said arcuate slot (124) of a corresponding one of said two side plates (12);

a second pivot axle (32) secured in said assembly space (14);

at least one pawl member (30) pivotally mounted on said second pivot axle (32) and having a first end formed with a first arm (33) containing a notch (34) detachably receiving said push rod (24), and a second end formed with a second arm (37) containing an abutting recess (38) having a periphery;

a wheel (42) rotatably received in said assembly space (14);

an actuating member (45) secured on said wheel (42) to rotate therewith and including two opposite drive stubs (450) each detachably abutting said periphery of said abutting recess (38) of said second arm (37) of said pawl member (30);

a speed reduction motor (40) mounted in said assembly space (14) to drive the wheel (42) rotating.

2. The electric safeguard door lock in accordance with claim 1, wherein said elongated plate (11) contains a hole (114), and said electric door lock further comprises a sensor (16) mounted in said hole (114).

3. The electric safeguard door lock in accordance with claim 1, wherein said elongated plate (11) contains a concave surface (116), and said electric door lock further comprises a positioning ball (18) abutting said concave surface (116).

4. The electric safeguard door lock in accordance with claim 1, wherein each of said two side plates (12) contains a locking hole (122), and said first pivot axle (22) has two ends each secured in said locking hole (122) of a corresponding one of said two side plates (12).

5. The electric safeguard door lock in accordance with claim 1, wherein said arcuate slot (124) of each of said two side plates (12) has two distal ends each containing a retaining recess (126).

6. The electric safeguard door lock in accordance with claim 1, wherein said lock bolt (20) contains a recessed surface (25) formed on the second end thereof, and said electric door lock further comprises a torsion spring (26) received in said recessed surface (25) and abutting said push rod (24).

7. The electric safeguard door lock in accordance with claim 1, wherein the wheel (42) has a worm gear (420) mounted thereon; and a worm (41) is mounted on said speed reduction motor (40) and meshing with said worm gear (420).

* * * * *